US010408203B2

(12) United States Patent
Chen

(10) Patent No.: US 10,408,203 B2
(45) Date of Patent: Sep. 10, 2019

(54) HAND AIR PUMP WITH AIR ACCUMULATION FUNCTION

(71) Applicant: LUFT TECH CO., LTD., Taoyuan (TW)

(72) Inventor: Lucas Chen, Taoyuan (TW)

(73) Assignee: LUFT TECH CO., LTD., Taoyuan (TW)

( * ) Notice: Subject to any disclaimer, the term of this patent is extended or adjusted under 35 U.S.C. 154(b) by 226 days.

(21) Appl. No.: 15/603,186

(22) Filed: May 23, 2017

(65) Prior Publication Data

US 2018/0340525 A1 Nov. 29, 2018

(51) Int. Cl.

| | |
|---|---|
| ***F04B 49/22*** | (2006.01) |
| ***F04B 33/00*** | (2006.01) |
| ***F04B 41/02*** | (2006.01) |
| ***F04B 39/12*** | (2006.01) |

(52) U.S. Cl.

CPC ..... *F04B 33/005* (2013.01); *F04B 39/123* (2013.01); *F04B 41/02* (2013.01); *F04B 49/22* (2013.01)

(58) Field of Classification Search

CPC ..... F04B 33/005; F04B 41/02; F04B 39/123; F04B 49/22; F04B 9/14; Y10T 137/86099; Y10T 137/85994; Y10T 137/86002; Y10T 137/86019; Y10T 137/8601

See application file for complete search history.

(56) References Cited

U.S. PATENT DOCUMENTS

| | | | | |
|---|---|---|---|---|
| 6,652,242 | B2 | 11/2003 | Wu | |
| 6,676,390 | B2 | 1/2004 | Wang | |
| 6,883,565 | B2 | 4/2005 | Marui | |
| 8,721,296 | B1 * | 5/2014 | Wang | F04B 33/005 137/565.15 |

* cited by examiner

*Primary Examiner* — Peter J Bertheaud
*Assistant Examiner* — Dnyanesh G Kasture
(74) *Attorney, Agent, or Firm* — Pai Patent & Trademark Law Firm; Chao-Chang David Pai

(57) ABSTRACT

A hand air pump with air accumulation function includes a control valve with a valve block and a control lever switchable between a first operation mode where the plunger assembly is allowed to pump compressed air into an air accumulation tank for accumulation, and a second operation mode where the air accumulation tank is opened to discharge the accumulated compressed air for inflating an attached tire and the plunger assembly is allowed to pump compressed air directly into the attached tire.

8 Claims, 9 Drawing Sheets

HAND AIR PUMP WITH AIR ACCUMULATION FUNCTION

BACKGROUND OF THE INVENTION

(a) Field of the Invention

The present invention relates to air pump technology and more particularly to a hand air pump equipped with an accumulation tank switchable to discharge accumulated compressed air or to use a plunger to pump air for inflating an inflatable object at once.

(b) Description of the Prior Art

A typical hand air pump, as seen in U.S. Pat. Nos. 6,652,242 and 6,676,390, generally comprises a cylindrical housing, a piston rod axially movably inserted into the cylindrical housing, a piston mounted at the front end of the piston rod and movable with the piston rod in the cylindrical housing, a handle fastened to the opposing rear end of the piston rod outside the cylindrical housing, a flexible air tube connected to a bottom end of the cylindrical housing, and a pump nozzle mounted at the distal end of the flexible air tube and adapted for connection to a tire or other inflatable object to be inflated. In operation, the piston rod is continuously moved back and forth, moving the piston to pump outside air into the attached tire or inflatable object. This design of hand air pump cannot store compressed air in advance for later discharge to inflate a tire or other inflatable object at a time when needed. There is known a hand air pump that is equipped with an air accumulation tank for accumulation of compressed air, as illustrated in U.S. Pat. No. 6,883,565. According to this design, an air accumulation tank is mounted at one side relative to the plunger assembly that is operable to pump air into the air accumulation tank for accumulation. When a tire or other inflatable object need be inflated, the control valve is rotated to discharge the accumulated compressed air out of the air accumulation tank into the tire or other inflatable object to be inflated. However, according to U.S. Pat. No. 6,883,565, when the control valve is rotated to discharge the accumulated compressed air out of the air accumulation tank into the tire or other inflatable object to be inflated, and the tire or inflatable object cannot be fully inflated by the discharged compressed air, the user has to rotate the control valve back to the previous position to close the air accumulation tank in order to allow the plunger assembly to pump air into the tire or other inflatable object. Thus, this design of hand air pump is still not satisfactory in function.

SUMMARY OF THE INVENTION

The present invention has been accomplished under the circumstances in view. The present invention mainly provides a hand air pump which is equipped with a control valve switchable between a first operation mode where the plunger assembly is allowed to pump compressed air into an air accumulation tank for accumulation, and a second operation mode where the air accumulation tank is opened to discharge the accumulated compressed air for inflating an attached tire and the plunger assembly is allowed to pump compressed air directly into the attached tire, thus facilitating quick inflation and convenient operation.

To achieve this and other objects of the present invention, a hand air pump according to the present invention comprises a base, an air accumulation tank mounted at the base and defining therein an air accumulation chamber, a control valve mounted at the top end of the air accumulation tank and disposed in communication with the air accumulation chamber of the air accumulation tank, a flexible air tube having a first end thereof connected to the control valve and an opposing second end thereof provided with a pump nozzle connectable to an external inflatable object to be inflated, and a plunger assembly mounted at the base and operable to pump compressed air into the control valve. The control valve comprises a valve block and a control lever. The valve block comprises a first valve hole, a second valve hole and an air outlet connection hole disposed in communication with one another. The first valve hole is disposed in communication with the air accumulation chamber of the air accumulation tank, having a first valve rod axially movable mounted therein. The second valve hole is disposed in communication with the air outlet connection hole, having a second valve rod axially movably mounted therein. The air outlet connection hole is connected to the first end of the flexible air tube. The control lever is movably mounted at one side of the valve block and operable to move the first valve rod and the second valve rod in the first valve hole and the second valve hole respectively. The first valve rod and the second valve rod are movable by the control lever to switch the plunger assembly between a first operation mode where the plunger assembly is allowed to pump compressed air into the air accumulation chamber for accumulation, and a second operation mode where the air accumulation chamber is opened to discharge the accumulated compressed air into the flexible air tube and the plunger assembly is allowed to pump compressed air directly into the flexible air tube.

Thus, the design of the valve block and control lever of the control valve of the hand air pump allows the hand air pump to be switched between a first operation mode and a second operation mode. When switched to the first operation mode, the plunger assembly can be operated to pump compressed air into the air accumulation chamber for accumulation. When switched to the second operation mode, the accumulated compressed air is discharged out of the air accumulation chamber into the flexible air tube to inflate the attached tire or other inflatable object to the state where the pressure in the air accumulation tank is kept in balance with the pressure in the attached tire or other inflatable object, and the plunger assembly is allowed to pump compressed air directly into the flexible air tube and the attached tire or inflatable object.

Other advantages and features of the present invention will be fully understood by reference to the following specification in conjunction with the accompanying drawings, in which like reference characters denote like components of structure.

DETAILED DESCRIPTION OF THE PREFERRED EMBODIMENTS

Figure 1:
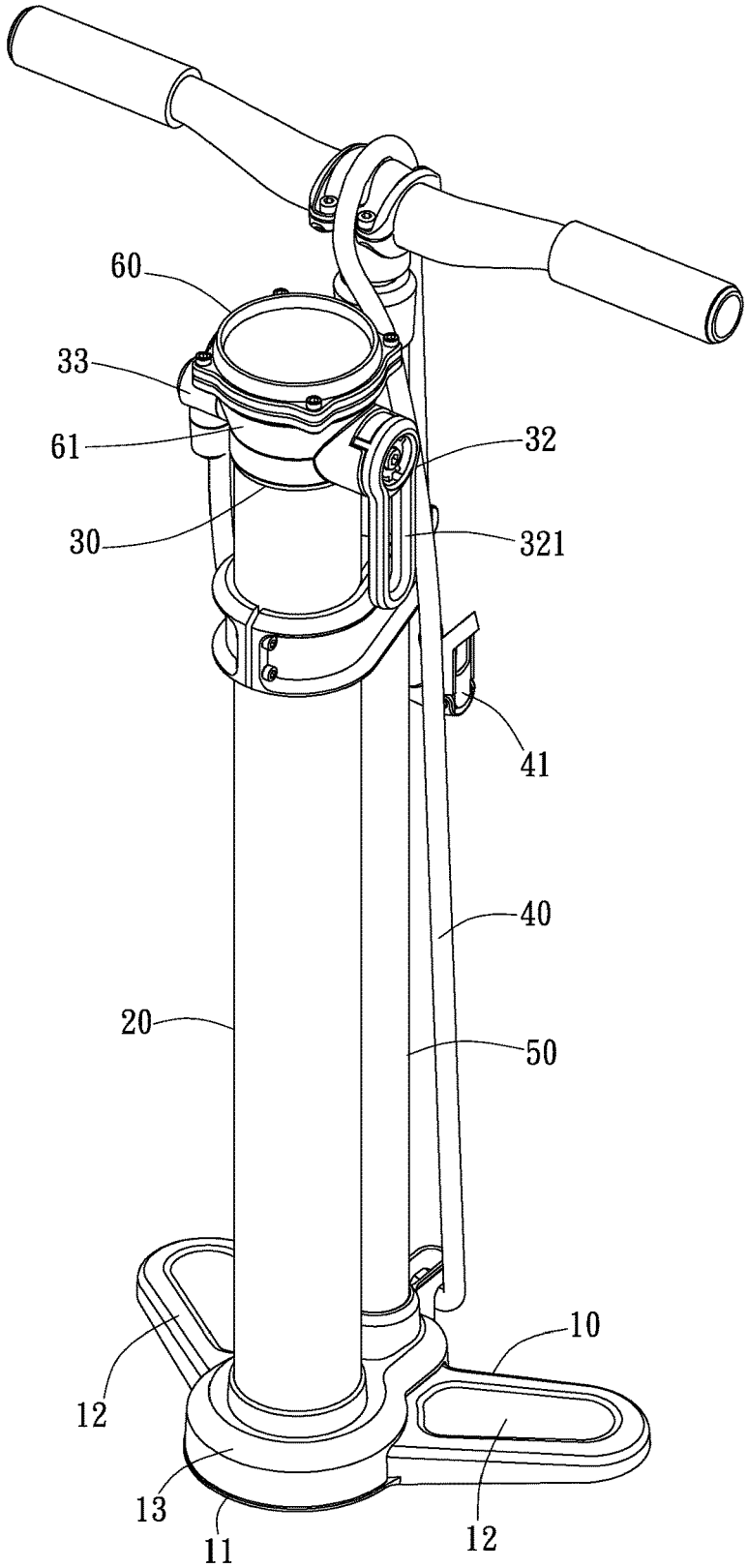
FIG. 1 is an oblique top elevational view of a hand air pump in accordance with the present invention.
Figure 2:
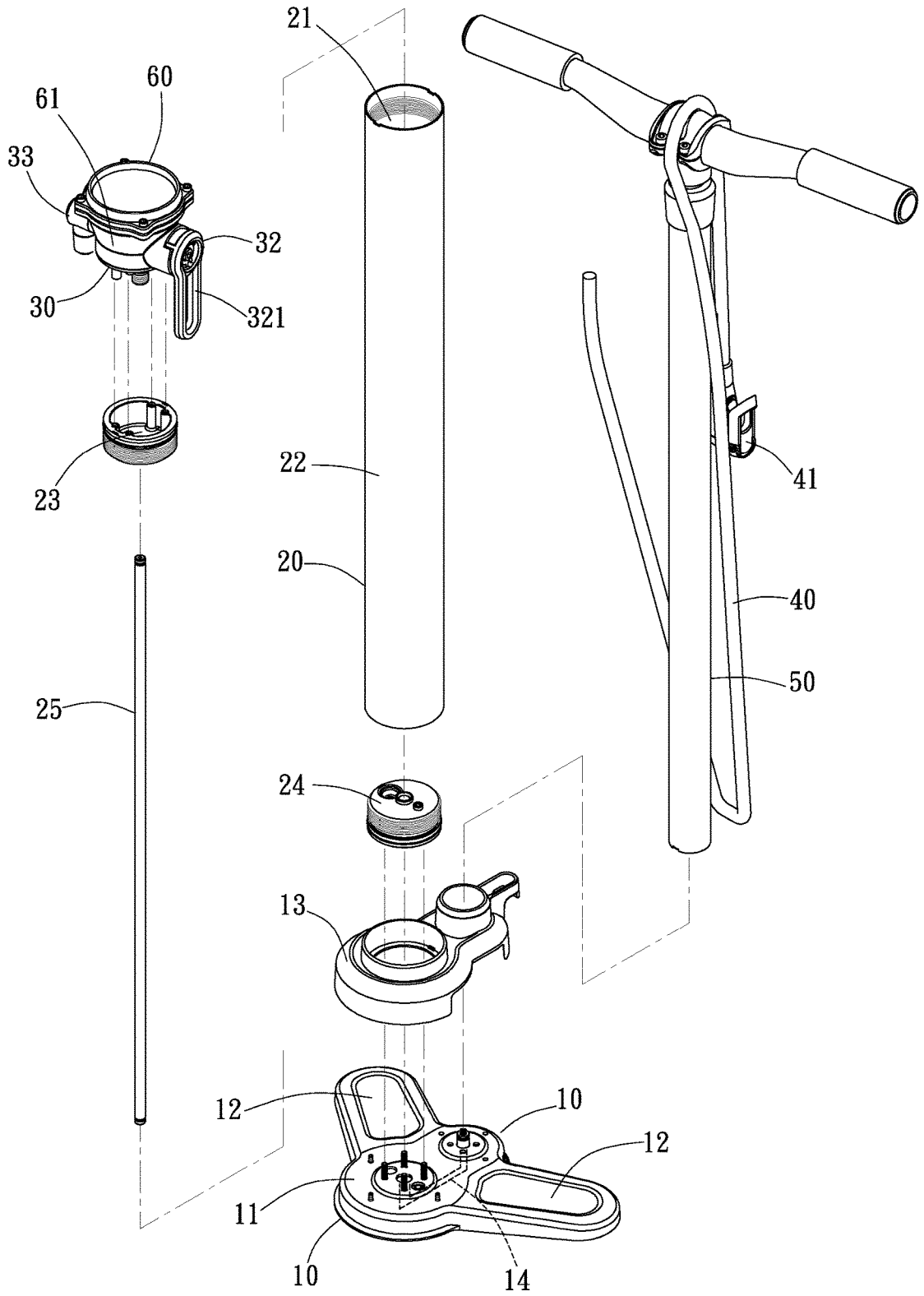
FIG. 2 is an exploded view of the hand air pump in accordance with the present invention.

Referring to FIGS. 1 and 2, a hand air pump with air accumulation function in accordance with the present invention is shown. The hand air pump enables the pumped air to be stored in an accumulation tank in advance, and then discharged to inflate the tire or other inflatable object after connection of the pump nozzle of an air tube. If the air pressure is insufficient, the hand air pump can then be continuously pumped to inflate the attached tire or other inflatable object to the saturated status. The hand air pump substantially comprises a base 10 in any of a variety of shapes and structures, an air accumulation tank 20, a control valve 30, a flexible air tube 40, a plunger assembly 50, and a pressure gauge 60. In one embodiment, the base 10 comprises a base block 11, two foot plates 12 connected to the base block 11, and a cover 13 covering the base block 11. The air accumulation tank 20 is mounted at the base block 11 of the base 10 and comprises an air accumulation chamber 21 therein for accumulating compressed air. The control valve 30 is mounted in a top end of the air accumulation tank 20 remote from the base 10 and disposed in communication with the air accumulation chamber 21 of the air accumulation tank 20 for controlling air entering the air accumulation chamber 21, or releasing air out of the air accumulation chamber 21. The flexible air tube 40 has one end thereof connected to the control valve 30, and an opposite end thereof provided with a pump nozzle 41 connectable to a tire or any other inflatable object to be inflated. The plunger assembly 50 is of an existing pump construction and technology mounted at the base block 11 of the base 10 adjacent to the air accumulation tank 20 for pumping outside air through the control valve 30 into the air accumulation chamber 21, or toward the flexible air tube 40. The pressure gauge 60 is coupled to the control valve 30 at a top side for measuring the pressure of the pumped air.

Referring to FIG. 2, the base block 11 of the base 10 defines therein an air flow channel 14. The air flow channel 14 has one end thereof connected to the plunger assembly 50, and an opposite end disposed in communication with the air accumulation tank 20 and the control valve 30. The air accumulation tank 20 comprises an upright cylindrical body 22, a top end cap 23 fastened to a top end of the upright cylindrical body 22 in an airtight manner, and a bottom end cap 24 fastened to an opposing bottom end of the upright cylindrical body 22 in an airtight manner. The air accumulation chamber 21 is defined in the upright cylindrical body 22 between the top end cap 23 and the bottom end cap 24. Further, the bottom end cap 24 is affixed to a top wall of the base 10; the top end cap 23 is affixed to a bottom wall of the control valve 30. The air accumulation tank 20 further comprises an inner tube 25 axially disposed in the air accumulation chamber 21 at the center. The inner tube 25 has a top end thereof connected to the top end cap 23 and disposed in air communication with (a second air inlet 371 in) the control valve 30, and an opposing bottom end thereof connected to the base 10 and disposed in communication with the air flow channel 14 and the plunger assembly 50.

Figure 3:
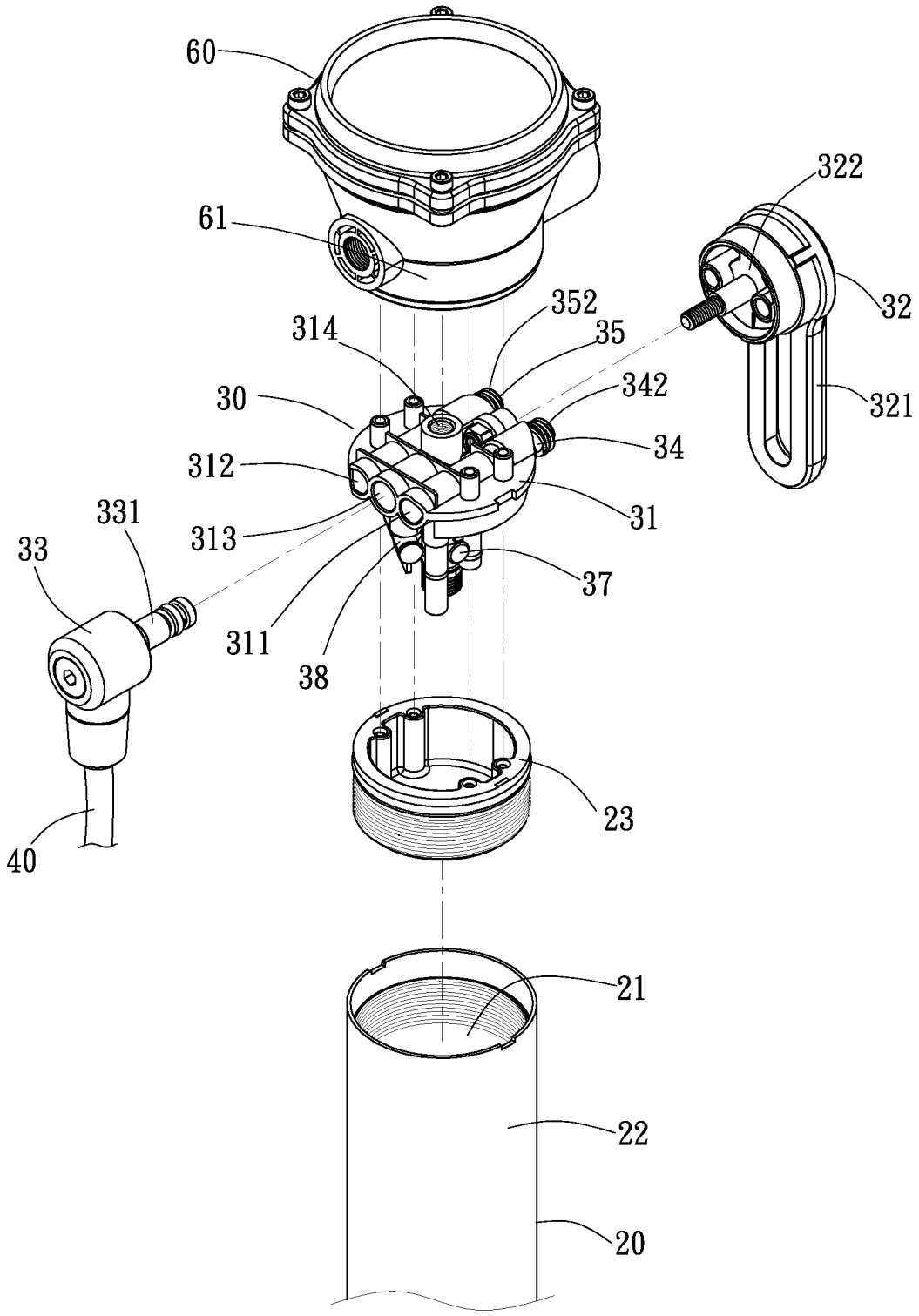
FIG. 3 is an exploded view of the control valve, the accumulation tank and the pressure gauge when viewed from a first angle.
Figure 4:
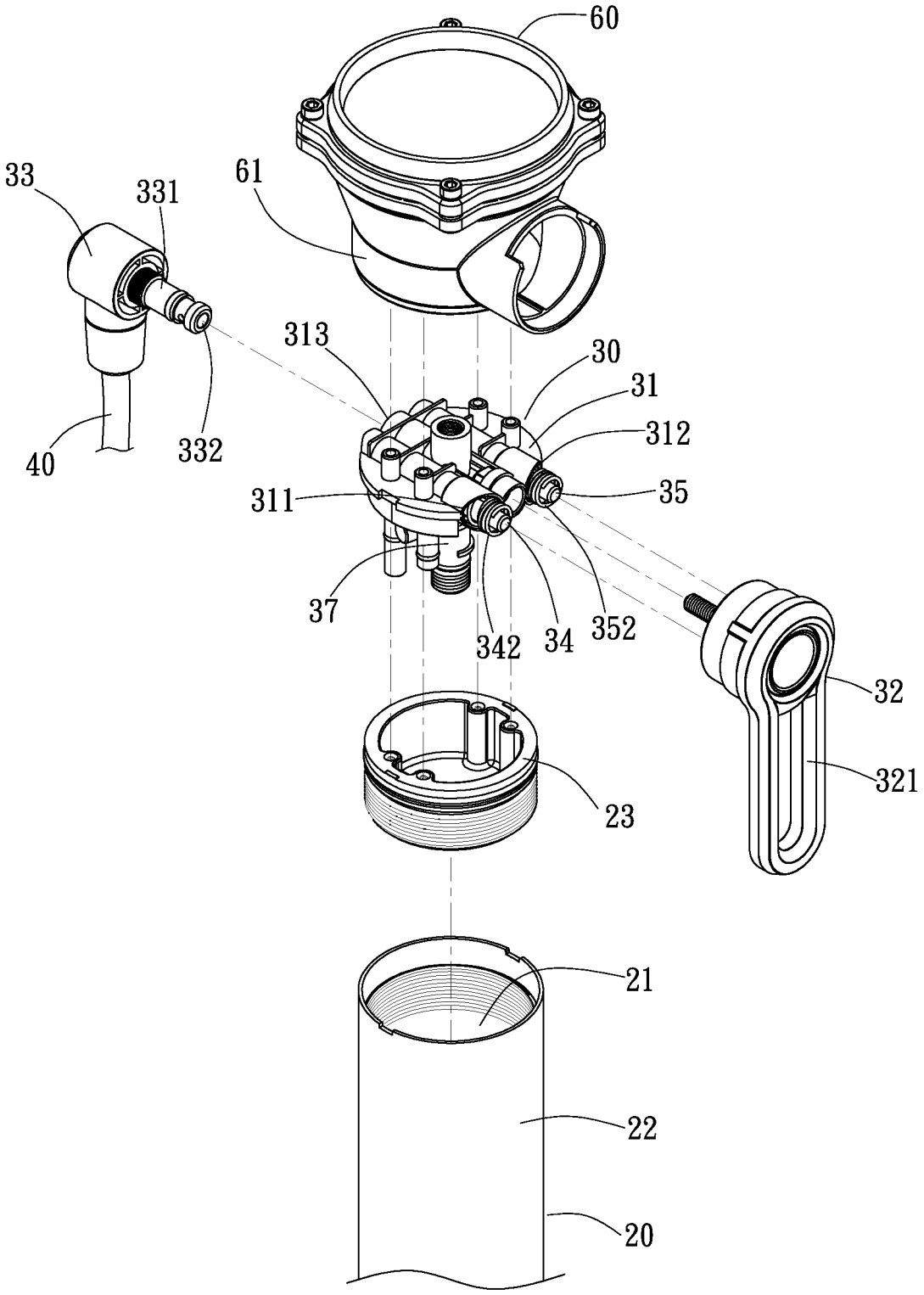
FIG. 4 is an exploded view of the control valve, the accumulation tank and the pressure gauge when viewed from a second angle.

Referring to FIGS. 3 and 4, the technical features of the present invention are outlined hereinafter. The control valve 30 comprises a valve block 31, a control lever 32, a connector 33, a first valve rod 34 and a second valve rod 35. The user can bias the control lever 32 to switch the valve block 31 between a first operation mode and a second operation mode. The valve block 31 is embedded in a bottom side inside a housing 61 of the pressure gauge 60. The valve block 31 comprises a first valve hole 311, a second valve hole 312 and air outlet connection hole 313 horizontally arranged one next to another on the valve block 31 and disposed in communication with one another. The first valve hole 311 is adapted for communication with the air accumulation chamber 21 of the air accumulation tank 20. The first valve rod 34 is axially movably mounted in the first valve hole 311. The second valve hole 312 is adapted for communication with the air outlet connection hole 313. The second valve rod 35 is axially movably mounted in the second valve hole 312. The air outlet connection hole 313 can be connected to the connector 33, or directly connected to one end of the flexible air tube 40. The control lever 32 is movably mounted at one side of the valve block 31. The control lever 32 is operable to move the first valve rod 34 axially in the first valve hole 311 and the second valve rod 35 axially in the second valve hole 312, switching the first valve rod 34 and the second valve rod 35 between a first operation mode where the plunger assembly 50 can pump air into the air accumulation chamber 21 and a second operation mode (air release mode) where the compressed air in air accumulation chamber 21 is released into the flexible air tube 40 or the plunger assembly 50 is allowed to pump air into the flexible air tube 40.

Figure 5:
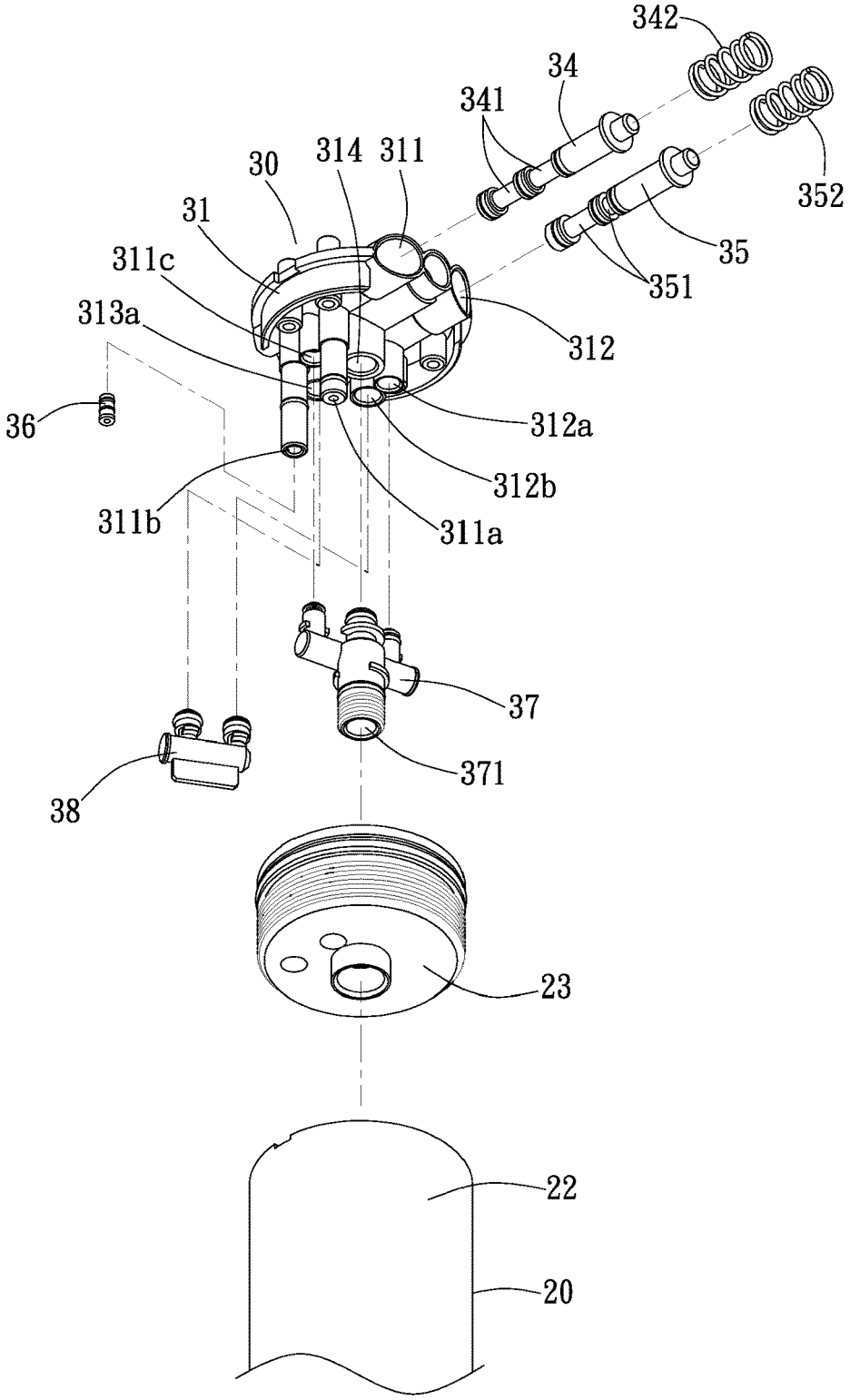
FIG. 5 is an exploded view of the control valve, the accumulation tank and the pressure gauge when viewed from a third angle.
Figure 6:
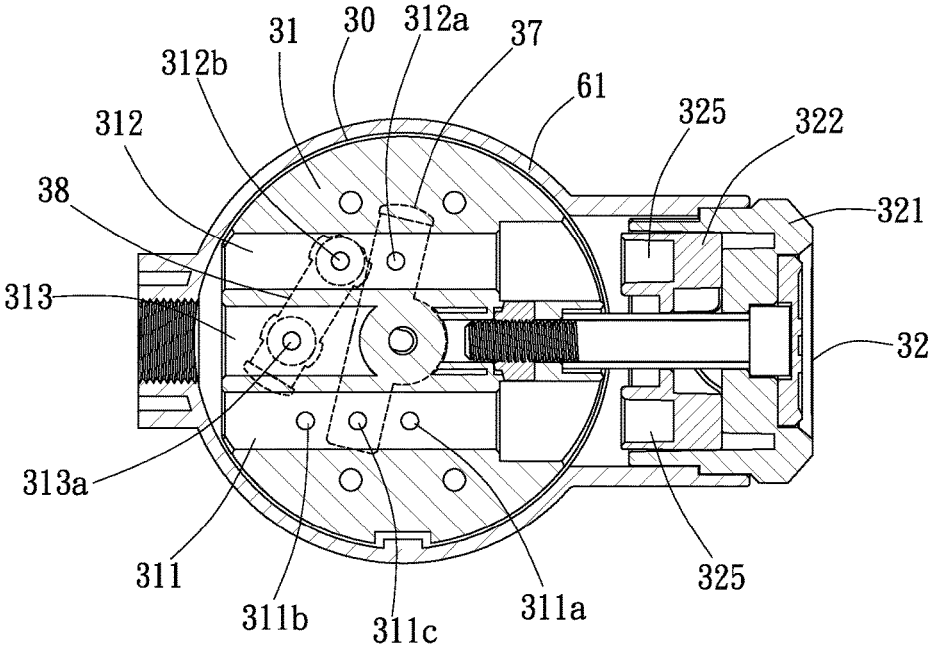
FIG. 6 is a sectional top view of the control valve.
Figure 7:
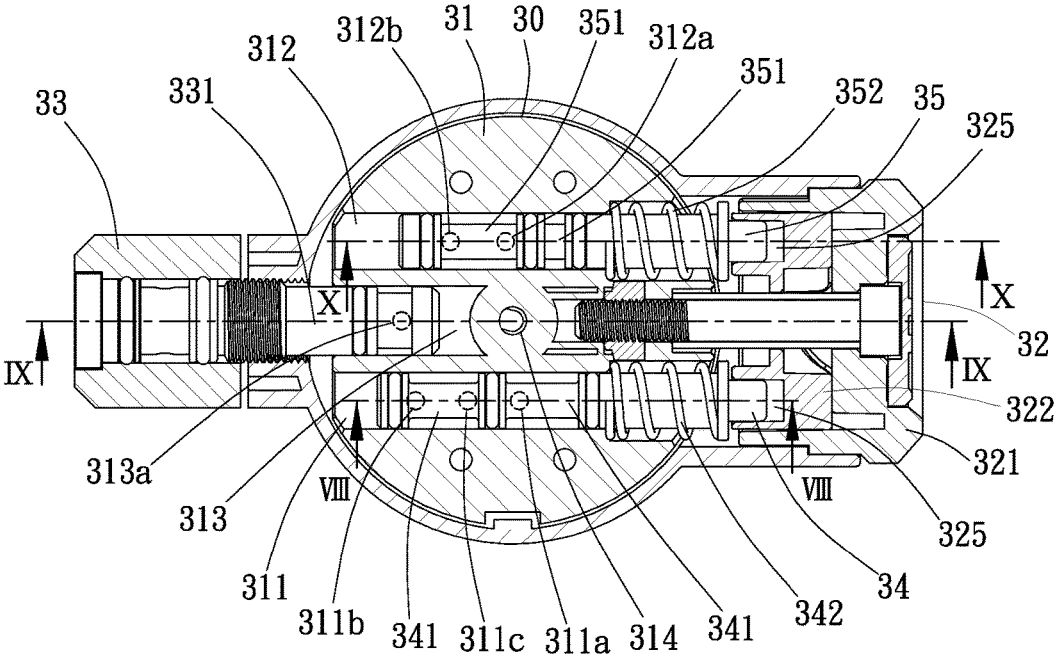
FIG. 7 is a schematic sectional top view illustrating the control valve switched to the second operation mode.
Figure 8:
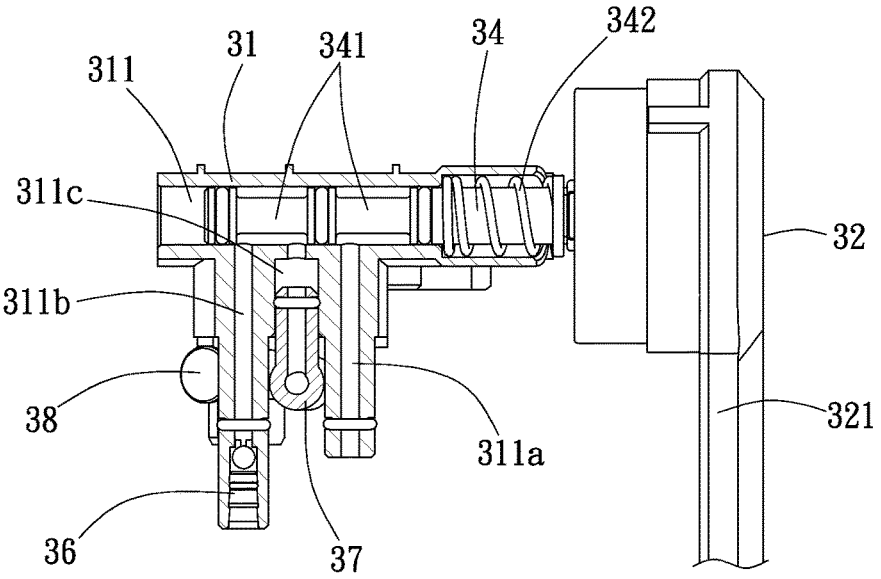
FIG. 8 is a sectional view taken along line VIII-VIII of FIG. 7.

The first valve hole 311 is adapted for communication with the air accumulation chamber 21 of the air accumulation tank 20. Preferably, there are mounted in the first valve hole 311 a first air inlet 311*a* (see FIG. 6, FIG. 7 and FIG. 8) and a first air outlet 311*b* (see FIG. 6, FIG. 7 and FIG. 10) respectively disposed in communication with the air accumulation chamber 21, and a two-way through hole 311*c* (see FIG. 6, FIG. 7 and FIG. 9) disposed in communication with the plunger assembly 50. When the first valve rod 34 and the second valve rod 35 are switched to the second operation mode (air release mode), a check valve 36 in the first air outlet 311*b* allows compressed air to be released from the air accumulation chamber 21 into the first valve hole 311. Since the first valve hole 311, the second valve hole 312 and the air outlet connection hole 313 are disposed in communication with one another, the compressed air goes further through the second valve hole 312 toward the air outlet connection hole 313. The second valve hole 312 defines therein a second air outlet 312*a* and a third air outlet 312*b*. The air outlet connection hole 313 defines therein a fourth air outlet 313*a*. Thus, the second air outlet 312*a* is disposed in communication with the first valve hole 311 or the two-way through hole 311*c*, and the third air outlet 312*b* is disposed in communication with the fourth air outlet 313*a*, enabling the compressed air to be released out of the check valve 36 and delivered through the second air outlet 312*a* into the second valve hole 312, and then through the third air outlet 312*b* and the fourth air outlet 313*a* into the air outlet connection hole 313. For enabling the aforesaid holes to be in communication with one another, as illustrated in FIGS. 5 and 6, the hand air pump further comprises a first pipe connector 37 and a second pipe connector 38. The first pipe connector 37 is connected with the two-way through hole 311*c* and the second air outlet 312*a*. The first pipe connector 37 further comprises a second air inlet 371 in communication with a top end of the inner tube 25, and thus the first pipe connector 37 is disposed in communication with the plunger assembly 50. The second pipe connector 38 is disposed in communication with the third air outlet 312*b* and the fourth air outlet 313*a*. Thus, the compressed air released from the air accumulation chamber 21 is guided through the first valve hole 311, the two-way through hole 311*c*, the first pipe connector 37 and the second air outlet 312*a* into the second valve hole 312, and then guided through the third air outlet 312*b*, the second pipe connector 38 and the fourth air outlet 313*a* into the air outlet connection hole 313, and then guided toward the flexible air tube 40.

Figure 11:
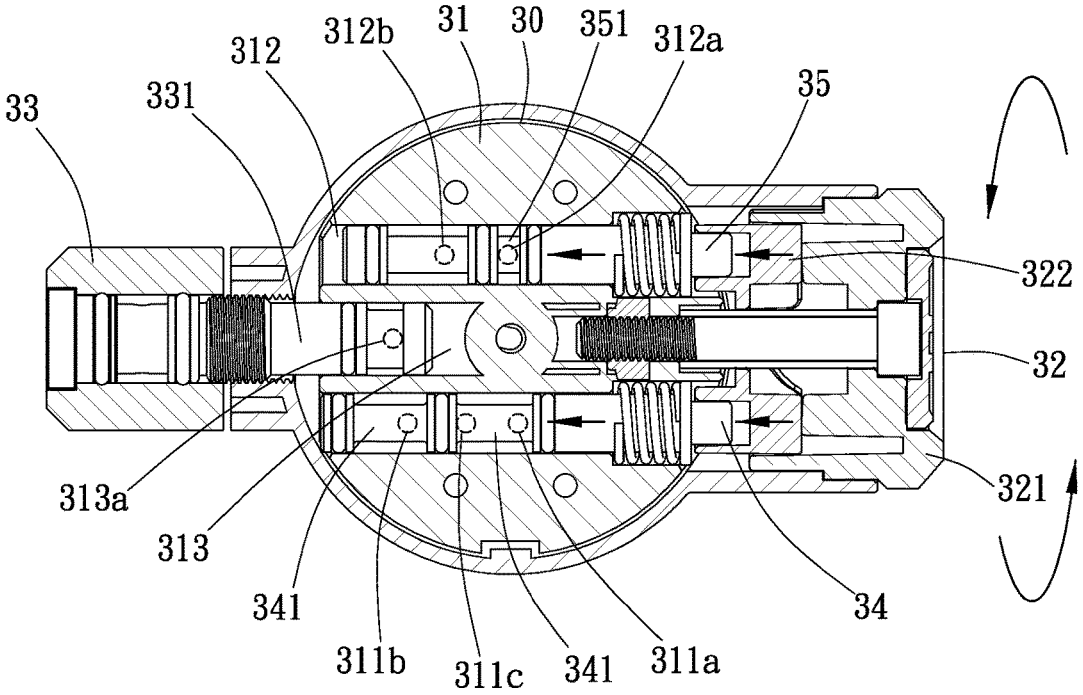
FIG. 11 is a schematic sectional view illustrating the control valve switched to the first operation mode for accumulation of pumped air in the air accumulation chamber.

The above description explains the structure, operation mode and inflation principle of the hand air pump where the control lever 32 is operated to switch the first valve rod 34 and the second valve rod 35 for enabling the compressed air to be released out of the air accumulation chamber 21 into the flexible air tube 40 (see FIG. 7) to inflate the attached tire or other inflatable object. If the attached tire or other inflatable object cannot be inflated to the saturated status at once, the user can operate the plunger assembly 50 to pump air. At this time, the pumped air is force to flow through the second air inlet 371 of the first pipe connector 37 into the first pipe connector 37 (see FIG. 9). Since the check valve 36 blocks the first air outlet 311*b* (see FIG. 8) and the first air inlet 311*a* is stopped by the first valve rod 34 (see FIG. 8), the compressed air is prohibited from entering the air accumulation chamber 21, and will go in the first pipe connector 37 to the second air outlet 312*a*, and then go through the second air outlet 312*a* to the second valve hole 312, and then go through the third air outlet 312*b*, the second pipe connector 38 and the fourth air outlet 313*a* to the air outlet connection hole 313 and the flexible air tube 40. Thus, the pumped air can be pumped into the attached tire or other inflatable object to fully inflate the attached tire or other inflatable object. When wishing to switch to the first operation mode for allowing the plunger assembly 50 to pump air into the air accumulation chamber 21, the user can bias the control lever 32 to move the first valve rod 34 and the second valve rod 35 to the first operation mode position (see FIG. 11), causing the first air outlet 311*b* and the second air outlet 312*a* to be blocked by the first valve rod 34 and the second valve rod 35 respectively, and enabling the first air inlet 311*a* of the first valve hole 311 to be kept in communication with the two-way through hole 311*c* via the first valve rod 34, and thus the compressed air pumped by the plunger assembly 50 is allowed to go through the two-way through hole 311*c* and the first air inlet 311*a* into the air accumulation chamber 21. Further, the first valve rod 34 and the second valve rod 35 each comprise two neck portions 341,351, and respectively loaded with a respective elastic member 342,352. The spaces around the neck portions 341,351 are adapted for guiding the compressed air. The elastic members 342,352 are respectively disposed around the first valve rod 34 and the second valve rod 35 for imparting an elastic restoring energy to the first valve rod 34 and the second valve rod 35 respectively to move the first valve rod 34 and the second valve rod 35 back to their previous position each time the first valve rod 34 and the second valve rod 35 have been moved.

Figure 9:
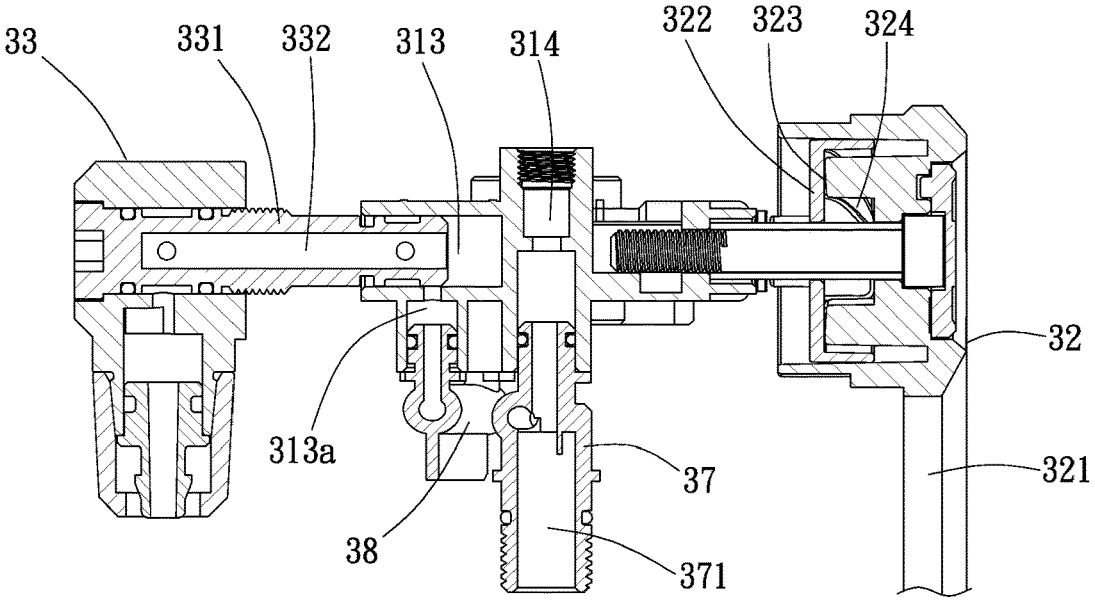
FIG. 9 is a sectional view taken along line IX-IX of FIG. 7.
Figure 10:
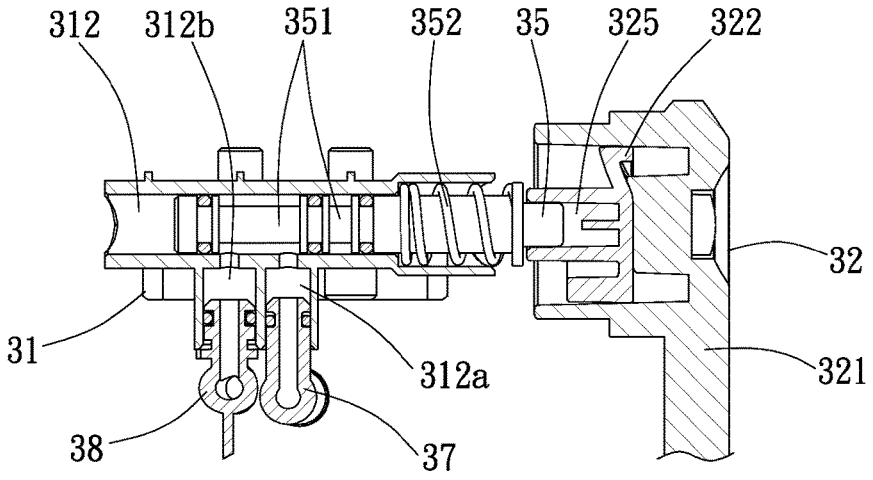
FIG. 10 is a sectional view taken along line X-X of FIG. 7.
Figure 12:
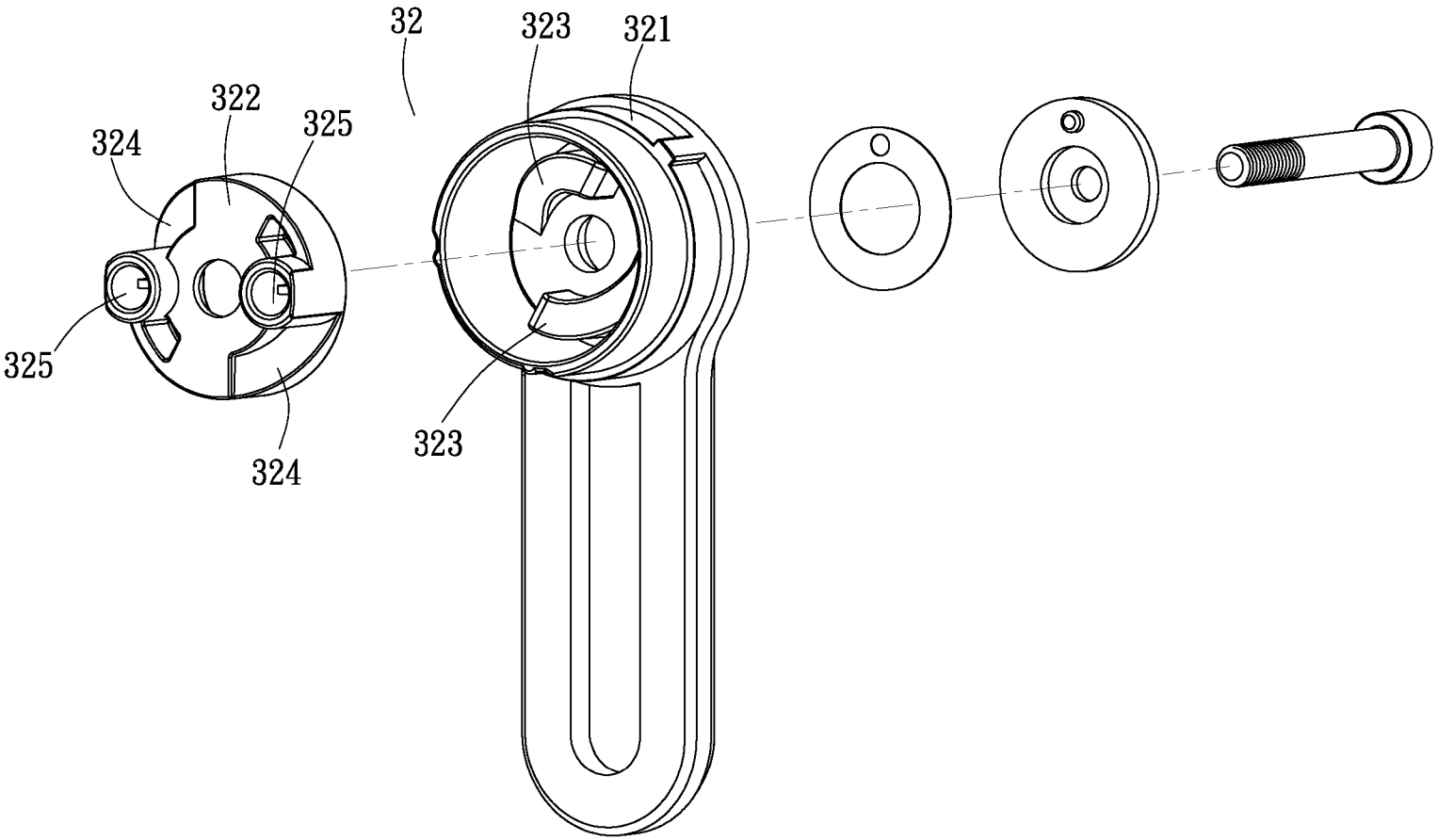
FIG. 12 is an exploded view of the control lever.

As illustrated in FIG. 3 and FIG. 9, the valve block 31 further comprises a pressure sensing hole 314 in the center. The pressure sensing hole 314 is connected to the pressure gauge 60, and the second air inlet 371 of the first pipe connector 37 is disposed in communication with the pressure sensing hole 314, and thus the pressure gauge 60 can measure the pressure of the compressed air. As illustrated in FIG. 12, the control lever 32 is rotatably mounted at one side of the valve block 31. Preferably, the control lever 32 comprises a grip 321, and a push block 322 mounted at the grip 321. The grip 321 comprises two first cam surfaces 323. The push block 322 comprises two second cam surfaces 324 respectively abutted against the first cam surfaces 323, and two coupling holes 325 respectively coupled to one end of the first valve rod 34 and one end of the second valve rod 35. Thus, the user can bias the grip 321 to move the first cam surface 323 over the second cam surfaces 324, forcing the push block 322 to move the first valve rod 34 and the second valve rod 35 to perform a switching operation.

Further, as illustrated in FIG. 3 and FIG. 9, the flexible air tube 40 has the first end thereof connected to the connector 33 of the control valve 30; the connector 33 has a third valve rod 331 located at one side thereof. The third valve rod 331 is movably inserted into the air outlet connection hole 313; an air outlet channel 332 is defined in the connector 33 and the third valve rod 331 and disposed in communication with the air outlet connection hole 313 and the flexible air tube 40. Thus, the compressed air can be inputted into the flexible air tube 40 to inflate the attached tire or other inflatable object.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A hand air pump operable to inflate an inflatable object, comprising:

a base;

an air accumulation tank mounted at said base, said air accumulation tank defining therein an air accumulation chamber;

a control valve mounted at a top end of said air accumulation tank and disposed in communication with said air accumulation chamber of said air accumulation tank;

a flexible air tube having a first end thereof connected to said control valve and an opposing second end thereof provided with a pump nozzle connectable to an external inflatable object to be inflated; and a plunger assembly mounted at said base and operable to pump compressed air into said control valve;

wherein said control valve comprises a valve block and a control lever, said valve block comprising a first valve hole, a second valve hole and an air outlet connection hole disposed in communication with one another, said first valve hole being disposed in communication with said air accumulation chamber of said air accumulation tank, said first valve hole having an axially movable first valve rod mounted therein, said second valve hole being disposed in communication with said air outlet connection hole, said second valve hole having an axially movable second valve rod mounted therein, said air outlet connection hole being connected to said first end of said flexible air tube; said control lever is movably and rotatably mounted at one side of said valve block and operable to move said first valve rod and said second valve rod in said first valve hole and said second valve hole respectively, said first valve rod and said second valve rod being movable by said control lever to switch said plunger assembly between a first operation mode where said plunger assembly is allowed to pump compressed air into said air accumulation chamber for accumulation, and a second operation mode where said air accumulation chamber is opened to discharge the accumulated compressed air into said flexible air tube and said plunger assembly is allowed to pump compressed air directly into said flexible air tube, wherein said control lever comprises a grip and a push block mounted at said grip, said grip comprising two first cam surfaces, said push block comprising two second cam surfaces respectively abutted against said first cam surfaces, and two coupling holes respectively coupled to one end of said first valve rod and one end of said second valve rod.

2. The hand air pump as claimed in claim 1, wherein said first valve hole defines therein a first air inlet and a first air outlet respectively disposed in communication with said air accumulation chamber, and a two-way through hole disposed in communication with said plunger assembly; said first air inlet is disposed in communication with said two-way through hole, allowing the compressed air pumped by said plunger assembly to go through said two-way through hole and said first air inlet into said air accumulation chamber; said first air outlet has a check valve mounted therein, said check valve being adapted for allowing the accumulated compressed air to be released from said air accumulation chamber into said first valve hole toward said air outlet connection hole via said second valve hole.

3. The hand air pump as claimed in claim 2, wherein said second valve hole defines therein a second air outlet and a third air outlet, said second air outlet being disposed in communication with one of said first valve hole and said two-way through hole; said air outlet connection hole defines therein a fourth air outlet, said fourth air outlet being disposed in communication with said third air outlet so that the compressed air released by said check valve is allowed to go through said second air outlet into said second valve hole and then to go through said third air outlet and said fourth air outlet into said air outlet connection hole.

4. The hand air pump as claimed in claim 3, further comprising a first pipe connector and a second pipe connector, wherein said first pipe connector is connected to said two-way through hole and said second air outlet, said first pipe connector comprises a second air inlet disposed in communication with said plunger assembly, and said second pipe connector is connected to said third air outlet and said fourth air outlet.

5. The hand air pump as claimed in claim 4, wherein said valve block further comprises a pressure sensing hole connected to a pressure gauge; said second air inlet of said first pipe connector is disposed in communication with said pressure sensing hole.

6. The hand air pump as claimed in claim 5, wherein said air accumulation tank comprises an upright cylindrical body, a top end cap fastened to a top end of said upright cylindrical body and affixed to a bottom wall of said control valve, a bottom end cap fastened to an opposing bottom end of said upright cylindrical body and affixed to a top wall of said base with said air accumulation chamber defined in said upright cylindrical body between said top end cap and said bottom end cap, and an inner tube axially mounted in said air accumulation chamber, said inner tube having a top end thereof connected to said top end cap and disposed in communication with said second air inlet and an opposing bottom end thereof connected to said bottom end cap and disposed in communication with said plunger assembly through an air flow channel in said base.

7. The hand air pump as claimed in claim 1, wherein said first valve rod and said second valve rod each comprise two neck portions and are respectively loaded with a respective elastic member, each said neck portion defining a space around the periphery thereof for guiding the compressed air, said elastic members being adapted for imparting an elastic restoring energy to said first valve rod and said second valve rod respectively to return said first valve rod and said second valve rod each time said first valve rod and said second valve rod have been moved by an external force.

8. The hand air pump as claimed in claim 1, wherein said first end of said flexible air tube is connected to said air outlet connection hole via a connector, said connector comprising an axially movable third valve rod mounted in said air outlet connection hole, said connector and said third valve rod defining therein an air outlet channel in communication with said air outlet connection hole and said flexible air tube.

* * * * *